US008355667B2

(12) United States Patent
Witzman

(10) Patent No.: US 8,355,667 B2
(45) Date of Patent: Jan. 15, 2013

(54) APPARATUS, METHOD, AND COMPUTER PROGRAM PRODUCT FOR OBTAINING BROADCAST CONTENT

(75) Inventor: Kevin R. Witzman, Monument, CO (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 1014 days.

(21) Appl. No.: 11/565,984

(22) Filed: Dec. 1, 2006

(65) Prior Publication Data

US 2008/0132162 A1 Jun. 5, 2008

(51) Int. Cl.
*H04H 40/00* (2008.01)

(52) U.S. Cl. ..... 455/3.06

(58) Field of Classification Search ..... 455/3.06
See application file for complete search history.

(56) References Cited

U.S. PATENT DOCUMENTS

| | | | | |
|---|---|---|---|---|
| 6,941,275 | B1 | 9/2005 | Swierczek | |
| 2002/0165847 | A1* | 11/2002 | McCartney et al. | 707/1 |
| 2005/0176366 | A1* | 8/2005 | Levy | 455/3.06 |
| 2006/0003694 | A1* | 1/2006 | Quelle | 455/3.06 |
| 2006/0154600 | A1* | 7/2006 | Ferris | 455/3.06 |

FOREIGN PATENT DOCUMENTS

| | | |
|---|---|---|
| CN | 1404669 | 3/2003 |
| GB | 2356270 | 5/2001 |

OTHER PUBLICATIONS

International Search Report and Written Opinion received in International Application No. PCT/US2007/024559, Oct. 1, 2008.

* cited by examiner

*Primary Examiner* — Duc Nguyen
*Assistant Examiner* — Ankur Jain

(57) ABSTRACT

An apparatus is provided for obtaining broadcast content disseminated by a broadcaster with which a perceiver of content is in unilateral communication. The apparatus includes a communications unit configured to receive a message from the content perceiver, the message including time information associated with the content and source information for the content. A processing device in communication with said communications unit and at least one broadcaster database is configured to obtain the time and source information included in the message and to use the time and source information to obtain identification of the content from the broadcaster database. The processing device may be in communication with at least one content provider database and is further configured to cause the identified content to be distributed from the content provider database to the perceiver. Methods and computer program products are also provided.

23 Claims, 3 Drawing Sheets

APPARATUS, METHOD, AND COMPUTER PROGRAM PRODUCT FOR OBTAINING BROADCAST CONTENT

BACKGROUND INFORMATION

It may often be the case that those confronted with broadcast content of one variety or another desire to retain a copy of the content for future use and enjoyment. For example, traditionally, songs were played via broadcast radio in an effort to create interest in a record, and those perceiving (i.e., hearing) the song and being so inclined might subsequently purchase, in a separate transaction, a record containing the song. In more recent times, other types of media have been subject to this transactional model, with television and film producers offering opportunities to obtain, usually purchase, cassette or digital video disc recordings of previously-disseminated content.

In order for one who perceives content to be able to subsequently obtain a copy of that content, the perceiver must be able to identify the content at some time following perception. For example, in order to purchase a song heard over the radio, a listener might wait for the radio broadcaster to identify the song by name and record the name, say, by writing it down. Later, the listener could then take the recorded song name to a music store to purchase the associated recording. However, in some cases, a radio broadcaster might not identify the song in the time that a listener is listening (because the identification would come at some time before or after the song, but not during). In other cases, a radio broadcaster might identify the song, but the listener is not in a position to record the information. In still other cases, a listener might be able to record the identity of a song, but might not be able to locate the place where the identity was recorded (e.g., the listener might write the song name on a piece of paper that is subsequently lost). In cases where the content is disseminated in other ways, such as television, all of these difficulties continue to exist.

Aside from the above problems with identifying content, a perceiver of content who desires to later obtain a copy of the content must presently undertake a separate transaction from the perception event. Returning to the example of listening to a song played over the radio, one who wishes to purchase such a song must, at some later time, access a physical or online music store to purchase the song.

BRIEF DESCRIPTION OF THE SEVERAL VIEWS OF THE DRAWING(S)

DETAILED DESCRIPTION

Exemplary embodiments now will be described more fully hereinafter with reference to the accompanying drawings, in which exemplary embodiments and examples are shown. Like numbers refer to like elements throughout.

Figure 1:
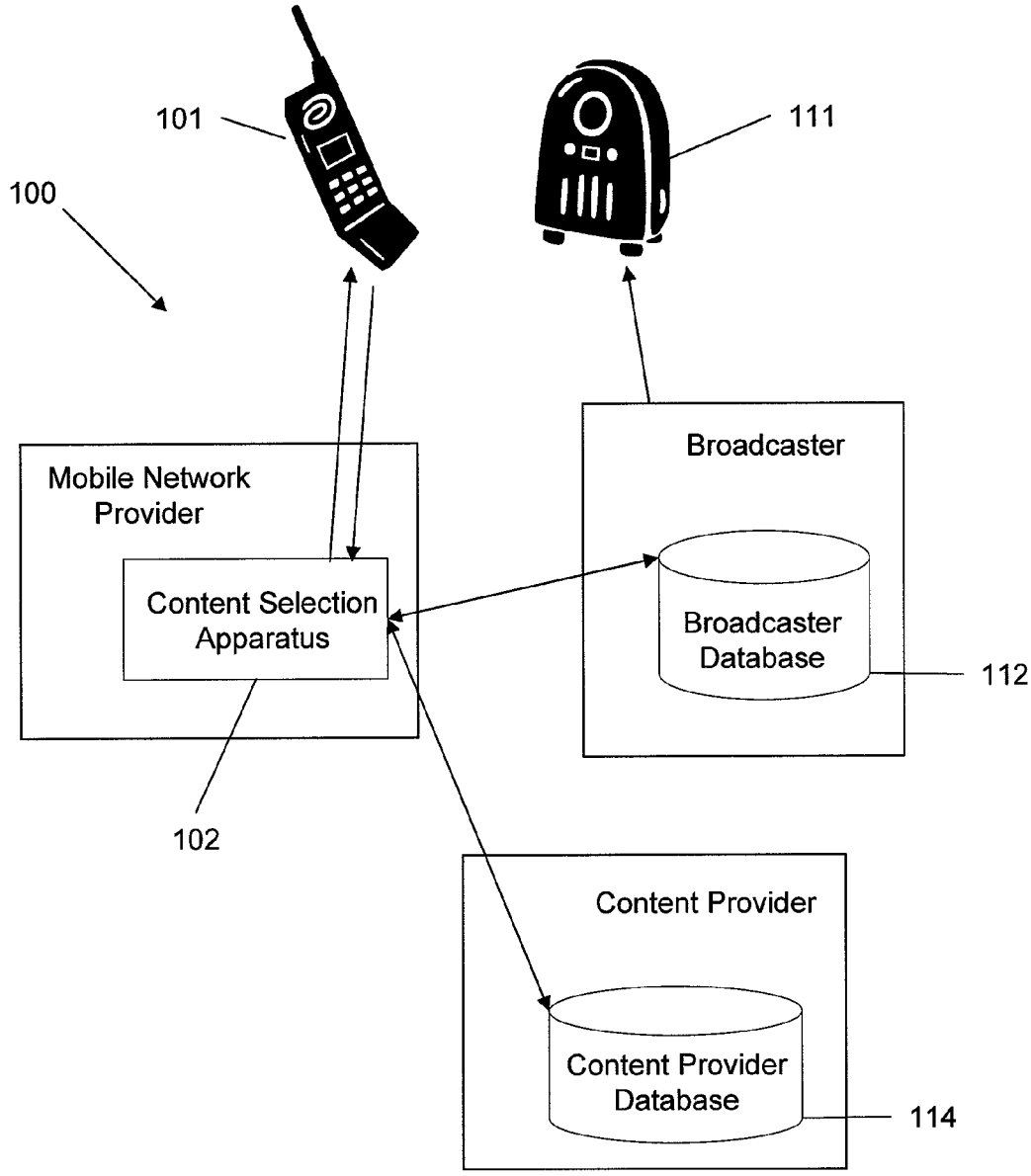
FIG. 1 is a schematic view of a system for purchasing broadcast content, the system being configured in accordance with one embodiment.
Figure 2:
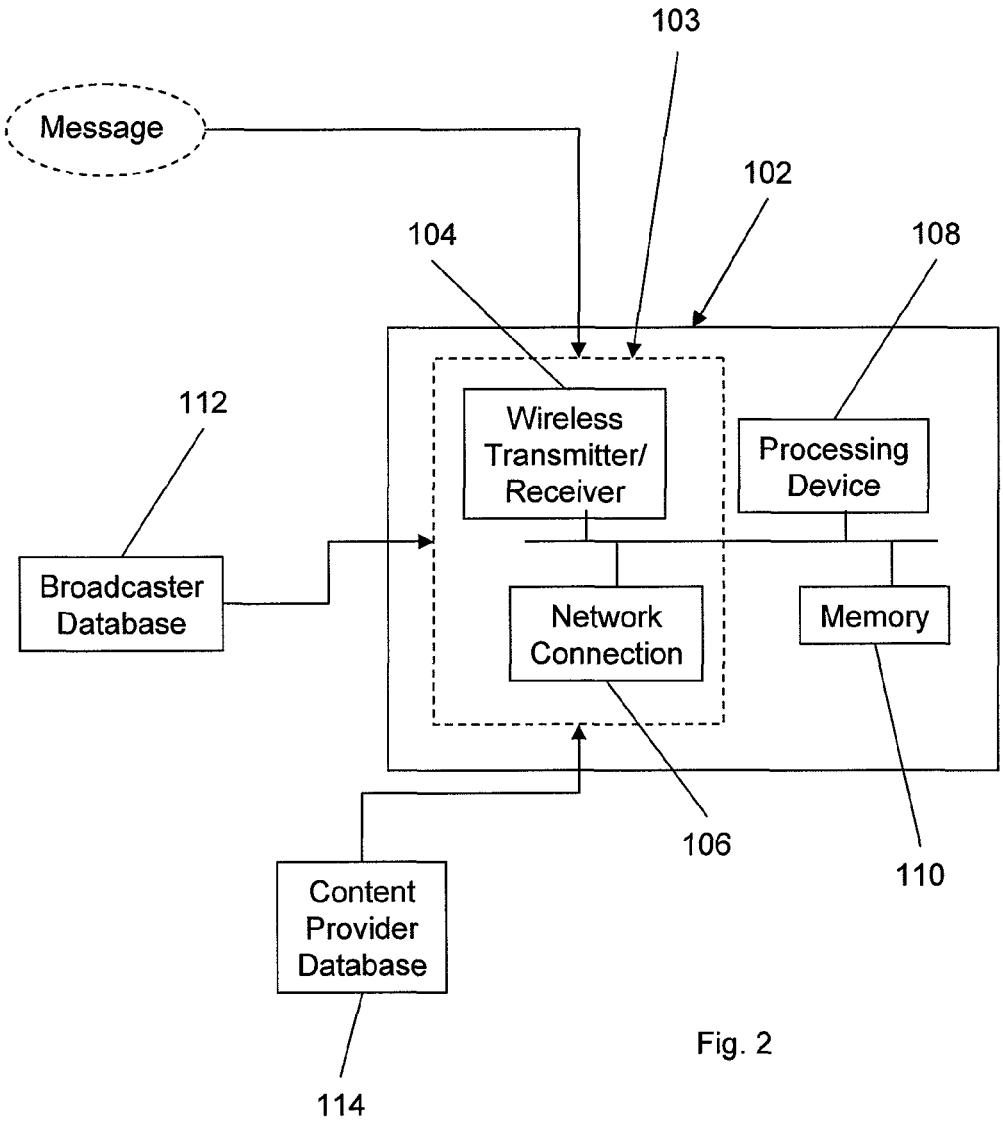
FIG. 2 is a schematic view of the system for purchasing broadcast content of FIG. 1, showing some of the internal structure of the content selection apparatus.

Referring to FIGS. 1 and 2, therein are shown schematic views of a system 100 for purchasing broadcast content, the system 100 being configured in accordance with one embodiment. The system 100 includes a mobile communications device, such as cellular telephone ("cell phone") 101. Cell phone 101 is operated by a user, the user being a perceiver of content. For example, the user may be perceiving content by listening to programming broadcast via radio waves and received/played by a conventional radio 111. However, content may be perceived in any number of ways, including via a visual or audio-visual display on a television, via satellite radio, via some other display or sound producing device, or even through a live performance. In each case, the user/perceiver is in unilateral communication with the entity disseminating the content, having no real ability to communicate with the entity at the time the content is being broadcast or disseminated, at least, not as a part of the communication by which the content is disseminated.

System 100 also includes content selection apparatus 102, potentially operated by a mobile network provider. The content selection apparatus 102 has a communications unit 103 configured to receive messages from the user via, for example, cell phone 101. Communications unit 103 may include, for example, a wireless transmitter/receiver 104 and/or a network connection 106 for connecting to a large area network, perhaps via the Internet. Content selection apparatus 102 may also include a processing device 108 and a memory 110, the communications unit 103, the processing device 108, and the memory 110 all being in communication with one another.

In one embodiment, the communications unit 103 is configured to receive messages including time information associated with perceived content and source information for the content. For example, a user may perceive a specific portion of content while listening to a radio station, R, at a time of day, t (the broadcast time for the content). The user could send a message (e.g., a text message or a voice message) with cell phone 101 that specifies time t and radio station R. Alternatively, the user may send a message indicating only radio station R, with such message sent at or around time t, and the message may automatically include an indication of the time at which the message was sent. While in the above example, source information related to a radio station, other types of information can act as source information, including information related to the settings on the device used to perceive the content at issue, such as the channel on a television or on a satellite radio, and information related to the identity of the broadcaster/disseminator/entertainment provider (e.g., "National Public Radio" or "CBS").

The processing device 108 may communicate with communications unit 103 to obtain the time and source information included in a message received by the communications unit 103. Processing device 108 may also be in communication with one or more broadcaster databases 112, each of the broadcaster databases 112 being associated with a broadcaster/disseminator of content and containing information about the variety of content disseminated by the associated broadcaster. A broadcaster database may, for example, include program listings identifying a chronological listing of programs (e.g., songs or shows) along with the starting and ending times for each program.

In one embodiment, processing device 108 may be configured to use the time and source information to obtain identification of perceived content from a broadcaster database 112. For example, the processing device 108 may use the time and source information to identify a specific broadcaster associated with specific content. Processing device 108 can then access a database 112 maintained by the specific broadcaster, perhaps communicating with a server of the identified broadcaster via network connection 106 of communications unit 103. In cases where the broadcaster database 112 includes a chronological program listing (e.g., a schedule, program guide, or the like), processing device 108 may use the time information of the message to obtain identification of the content broadcast by the specific broadcaster at the specific broadcast time. In some cases, the source information alone may be sufficient to identify the content, such as in cases where the broadcaster can be associated with one portion of content at a given time or where a certain radio/television station only shows one program for a day/week/month.

In some cases, processing device 108 may be configured to use the time and source information contained in a message to obtain from a broadcaster database a list of programming broadcast in a range of time related to the time information included in the message. For example, if a message included reference to a time t, processing device might obtain a listing of all of the programming being disseminated by the broadcaster within 20 minutes of t. This list could then be presented to a user, and the content of interest could be selected by the user from the list. This scheme might be useful, for example, in cases where the time t is generated automatically at the time when the message is sent, to accommodate cases where message entry/transmission takes longer than the time remaining in the broadcast of perceived content, such that message transmission occurs after the termination of content perception. This scheme might also be helpful to assure that the proper content is identified in cases where times associated with the message, either automatically generated or specified by a user, are not necessarily synchronized with times listed in a broadcaster database regarding program start and end times.

In some cases, processing device 108 may be in communication with only one broadcaster/broadcaster database 112. However, in other embodiments, processing device 108 may be capable of communicating with multiple broadcaster databases 112. In such cases, processing device 108 may, prior to identifying content, identify the appropriate broadcaster database 112 from amongst the multiple broadcaster databases 112. In one embodiment, a message may include a broadcaster identity that can be used to select the appropriate broadcaster database 112. In other embodiments, the message may include information useful in identifying the broadcaster, such as a location and radio station (e.g., "New York, FM 100.3"). Processing device 108 can be configured to deduce the broadcaster associated with such information.

As mentioned earlier, content selection apparatus 102 may include memory 110. Processing device 108 may obtain content identification and store such indication in memory 110. The content identification can remain in memory 110 until it can be retrieved and/or accessed by a user. This can be done by establishing user access to the memory 110, or content selection apparatus 102 can be configured to transmit a copy of the identification information to a user.

A user can use the identification, for example, to subsequently purchase a copy of the content (e.g., if the content is a song, a user can use the identification to buy a copy of the song from a digital music provider or a record store). Alternatively, the content selection apparatus 102 can be configured to automatically obtain a copy of the content from a content provider, possibly based on pre-determined settings of a user, in response to a command from a user, or automatically for each portion of content identified. The content provider may be an entity that solely distributes content, or in some cases may be a broadcaster (e.g., television broadcasters may make copies of programs available for a price). In one embodiment, processing device 108 may obtain a digital copy of the identified content from a content provider database 114 (possibly maintained on a server operated by the content provider) and store the digital copy in memory 110. In another embodiment, processing device 108 may cause a copy of the identified content to be transmitted to the user or to a location specified by the user (e.g., an electronic mail address), either from the content selection apparatus 102 or directly from a content provider database 114. In one embodiment, the content provider is any one of a number of existing commercial content providers, such as, for example, Napster LLC. When interacting with a commercial content provider, processing device 108 can be configured to pre-pay for any obtained content and to issue a charge to a user, possibly coupled with a transaction fee, or can be linked to a credit and/or debit account associated with the user.

While the content selection apparatus 102 has been described above with respect to interactions with a single user, the content selection apparatus 102 may operate in conjunction with multiple users. In such cases, content selection apparatus 102 would operate largely as described above, with communications unit 103 being configured for such a multiple content perceiver/user environment. However, in some embodiments, messages received from users by content selection apparatus 102 may include perceiver/user identification information (e.g., based on information entered by a user or based on identifying information automatically generated by the cell phone 101 utilized in sending the message). Processing device 108 can use the user identification information to assure that requested content is distributed to the correct user, and also can assure that the correct user is charged or receives a charge for the obtained content.

Figure 3:
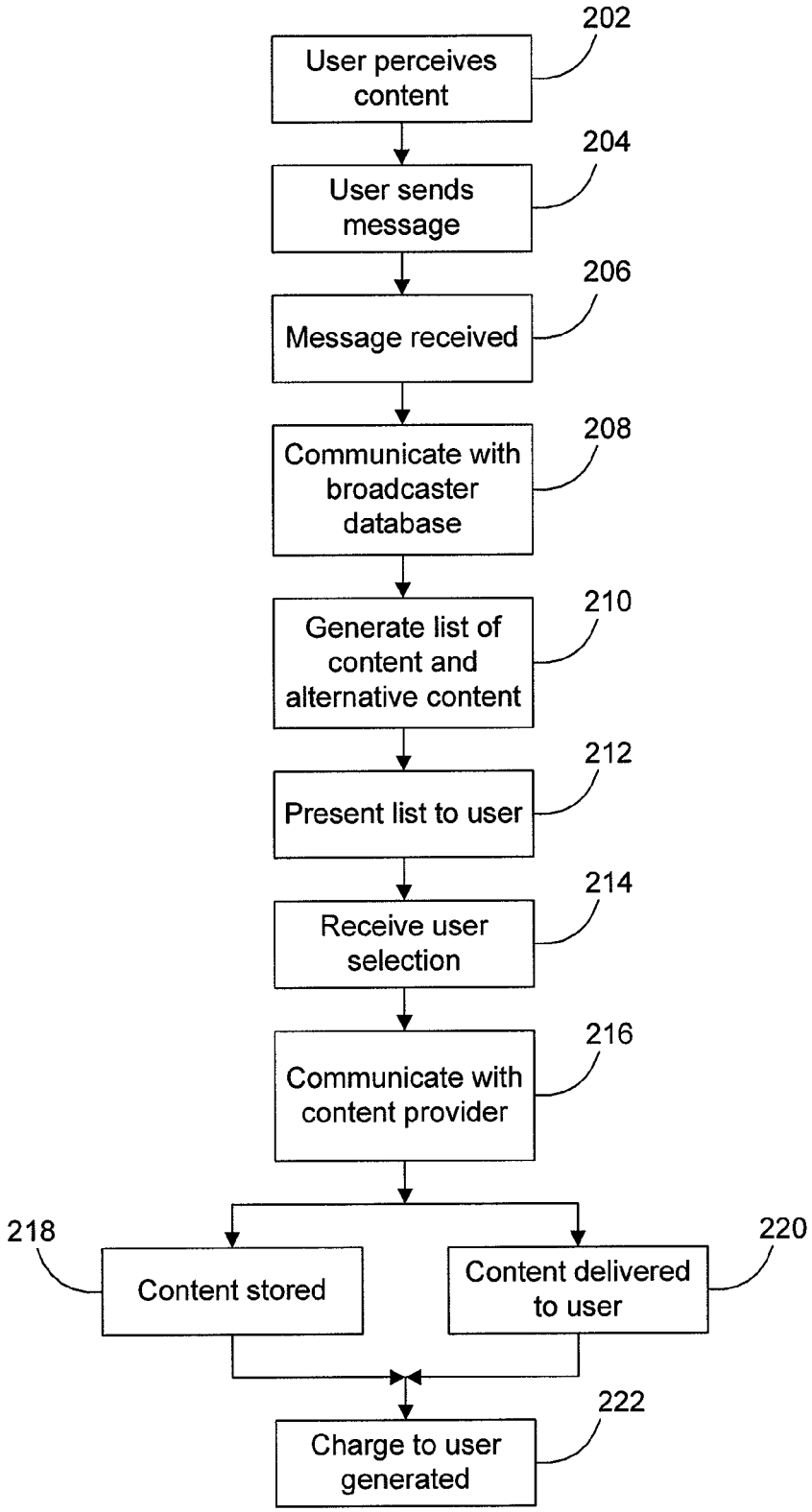
FIG. 3 is a flowchart describing an exemplary use of the system of FIG. 1.

Referring to FIGS. 1-3, an exemplary use of the above described system 100 is now described. The exemplary use starts at Block 202 with a user perceiving content, for example, hears a song via a conventional radio 111. The user may be interested in the content, and may wish to learn more about the content or the producer of the content or may wish to retain a copy of the content for future use. In any of these cases, the user may want to identify the content, but either may not be capable of identifying the content (e.g., user hears the last portion of a song on the radio and the song identity is not provided) or may not be in a position to record provided identity information.

At Block 204, the user can send a message, for example, via cell phone 101, providing time and source information related to the song. The time information may include, for example, a broadcast time of the content and/or a time of generation of the message, and the source information may include, for example, identification of the broadcaster, the radio station, and location, or some subset thereof. In some embodiments, the message also includes information identifying the user, such that user-specific settings of the apparatus 102 (discussed below) might be employed.

The message is received by apparatus 102 at Block 206. At Block 208, apparatus 102 uses the time and source information from the message to identify and initiate communication with a database 112 of a broadcaster associated with the time and source information. For example, the broadcaster of the content may be automatically identified based on the source information. The broadcaster database may include programming schedules for programming broadcast by the broadcaster, the schedules being maintained by the broadcaster. From these schedules, apparatus 102 could generate, at Block 210, a list (potentially) including both the song and alternative songs based on one or both of the time or source information. The list, for example, may contain a list of songs played on an identified radio station within a half hour of the time specified in the message from the user.

At Block 212, the list including the song and alternative songs is presented to the user, perhaps via a display of user's cell phone 101. The user may then identify the desired song by selecting the song from the list of songs (again, for example, via cell phone 101) at Block 214. In an alternative embodiment, apparatus 102 may be configured to automatically identify the song based on the time and source information, and in such cases, Blocks 210-214 may not be necessary.

At Block 216, apparatus 102 may identify and initiate communication with a content provider database, for example, a database maintained by a digital music provider such as Napster LLC. Apparatus may communicate song identification (e.g., song title and/or artist) to the content provider. At Block 218, apparatus 102 may then obtain a copy of the identified song from the content provider. This copy can be stored in memory 110 or delivered to the user. Alternatively, or in addition, at Block 220, apparatus 102 may instruct the content provider to transmit a copy of the song to a location specified by the user, for example, an electronic mail address specified in the message or a web address specified by the user in pre-determined settings stored in the memory 110 of apparatus 102. In some embodiments, a user may be able to select whether or not the song should be obtained by apparatus 102, as a user may simply want to obtain identification of the song for later use. Finally, at Block 222, apparatus may generate a charge for the content, to be applied against a credit/debit account associated with the user or to be paid later by the user. Alternatively, apparatus may enable the content provider to bill the user directly.

In one embodiment, a mobile communications device may serve as a real-time, or at least near real time, mechanism for initiating the purchase (and possibly download, either to the mobile communications device or to another location) of broadcast audio content (e.g., broadcast audio content). This task may be accomplished via the use of "Common Short Codes," which are commonly defined as short standardized numeric codes (often five or six digits) to which text messages can be sent from a mobile communications device. Such common short codes are already in use by multiple commercial mobile network providers and associated subscribers, being used to provide access to a wide variety of mobile content.

It is understood that at least some of the operations described in conjunction with FIG. 3 may be performed through hardware, software, or combinations thereof. Therefore, embodiments may take the form of hardware systems and/or apparatuses, software, or combinations thereof. As an example, embodiments may include a computer program product that includes a computer-readable storage medium (e.g., memory) and one or more executable portions (e.g., software) stored by the computer-readable storage medium for performing the operations described herein upon execution thereof. For example, the executable portions may be stored in memory of one or both the mobile communication device 101 and the content selection apparatus 102 such that the respective processors or other computing devices of one or both of the mobile communications device 101 and the content selection apparatus 102 may access and execute the executable portions of the computer program product in order to perform the functions described herein including, for example, those depicted in FIG. 3.

In the preceding specification, various embodiments of the claimed invention have been described. It will, however, be evident that various modifications and changes may be made thereunto without departing from the broader spirit and scope of the invention as set forth in the claims that follow. For example, in some embodiments, the content selection apparatus, broadcaster database, and content provider database may all be operated by a single entity, or may be operated by any number of entities and in any combination. The specification and drawings are accordingly to be regarded in an illustrative rather than restrictive sense.

That which is claimed:

1. An apparatus comprising:

a communications unit configured to receive a message from a mobile communications device operated by a perceiver of audio content disseminated by a broadcaster with which the perceiver is in unilateral communication, the message including time information associated with the audio content and source information for the audio content, wherein said communications unit is further configured to receive messages from multiple perceivers of respective audio content disseminated by one or more broadcasters with which the perceivers are in respective unilateral communication, and wherein the messages further include perceiver identification information;

a memory; and a processing device in communication with said communications unit, said memory, at least one broadcaster database, and at least one content provider database, said processing device configured to obtain the time, source, and perceiver identification information included in each message, use the time and source information to obtain identification of the audio content from the broadcaster database, and instruct a content provider maintaining the content provider database to transmit a copy of the audio content to a location specified by pre-determined settings of a user, wherein the pre-determined settings of the user are stored in said memory;

wherein the at least one broadcaster database includes multiple broadcaster databases, and said processing device is configured to use the source information to identify an associated broadcaster database from the multiple broadcaster databases that is associated with the audio content and to use at least one of the time or source information to obtain identification of the audio content from the associated broadcaster database;

wherein the apparatus is operated by a mobile network provider and is communicatively disposed between the mobile communications device and the content provider database.

2. An apparatus according to claim 1, wherein the time and source information includes one or more of the features selected from the group consisting of: a broadcast time of the audio content, identification of the broadcaster, and a time of generation of the message.

3. An apparatus according to claim 1, wherein the source information includes settings associated with the mobile communications device operated by the perceiver to perceive the audio content.

4. An apparatus according to claim 1, wherein said processing device is further configured to use the time and source information to obtain from the broadcaster database a list of programming broadcast in a range of time related to the time information included in the message.

5. An apparatus according to claim 1, wherein said processing device is further configured to cause a charge for the copy of the audio content transmitted to the user.

6. An apparatus according to claim 1, wherein said processing device is configured to use the time and source information to obtain, for each message, identification of the audio content from the broadcaster database, and to instruct, for each message, the content provider maintaining the content provider database to transmit a copy of the audio content to a location specified by pre-determined settings of a user, wherein the user is the perceiver identified by the associated message.

7. An apparatus according to claim 1, wherein said processing device is further configured to automatically obtain, from the content provider database, a copy of the audio content disseminated by the broadcaster, and store the obtained copy of the audio content to said memory.

8. A method comprising:

receiving, by a content selection apparatus operated by a mobile network provider, a message from a mobile communications device associated with a perceiver of audio content disseminated by a broadcaster with which the perceiver is in unilateral communication, the message including time information associated with the content and source information for the audio content, and further receiving messages from multiple perceivers of respective audio content disseminated by one or more broadcasters with which the perceivers are in respective unilateral communication, and wherein the messages further include perceiver identification information;

obtaining the time, source, and perceiver identification information included in each message, automatically identifying, by the content selection apparatus operated by the mobile network provider, the audio content based on the time and source information included in the message; and instructing, by the content selection apparatus operated by the mobile network provider, a content provider maintaining a content provider database to transmit a copy of the audio content to a location specified by pre-determined settings of a user, wherein the pre-determined settings of the user are stored in memory of the content selection apparatus operated by the mobile network provider; and using the source information to identify an associated broadcaster database from multiple broadcaster databases that is associated with the audio content and using at least one of the time or source information to obtain identification of the audio content from the associated broadcaster database.

9. The method according to claim 8, wherein the receiving a message including time and source information includes one or more of the following: receiving a message including a broadcast time of the audio content, receiving a message including identification of the broadcaster, and receiving a message including a time of generation of the message.

10. The method according to claim 8, wherein the automatically identifying the audio content includes automatically identifying the broadcaster of the audio content based on the source information and automatically obtaining identification of the audio content from the broadcaster based on at least one of the time and source information.

11. The method according to claim 8, wherein the receiving a message from the mobile communications device operated by the perceiver of the audio content includes receiving a message including identification information associated with the perceiver.

12. The method according to claim 11, wherein the receiving a message including identification information associated with the perceiver includes receiving a message including identification of the mobile communications device from which the message was received.

13. The method according to claim 8, further comprising generating and delivering, by the content selection apparatus, a charge to the user for the copy of the audio content.

14. The method according to claim 8, wherein the receiving a message including time information associated with the audio content and source information for the audio content includes receiving a message including settings associated with the mobile communications device operated by the perceiver to perceive the audio content.

15. The method according to claim 8, wherein the automatically identifying the audio content includes automatically generating a list including both the audio content and alternative audio content based on the time and source information, and further comprising selecting the audio content from the list.

16. The method according to claim 15, wherein the automatically generating a list including both the audio content and alternative audio content includes generating a list of programming broadcast in a range of time related to the time information included in the message based on the time and source information.

17. The method according to claim 8, wherein the location specified by the pre-determined settings includes an electronic email address.

18. The method according to claim 8, wherein the location specified by the pre-determined settings includes a web address.

19. The method according to claim 8, further comprising:

pre-paying, by the content selection apparatus operated by the mobile network provider, the content provider for the copy of the audio content; and generating and delivering, by the content selection apparatus operated by the mobile network provider, a charge to the user for the copy of the audio content.

20. The method according to claim 8, further comprising:

automatically obtaining from the content provider, by the content selection apparatus operated by the mobile network provider, a copy of the audio content disseminated by the broadcaster; and storing, by the content selection apparatus operated by the mobile network provider, the obtained copy of the audio content to the memory of the content selection apparatus.

21. A system comprising:

a mobile communications device operated by a perceiver of audio content disseminated by a broadcaster with which the perceiver is in unilateral communication, the mobile communications device configured to transmit a message including time information associated with the audio content and source information for the audio content, and wherein each of a plurality of mobile communications devices is operated by a respective perceiver configured to transmit a message associated with respective audio content disseminated by one or more broadcasters with which each respective perceiver is in respective unilateral communication, and wherein each message further includes perceiver identification information; and a content selection apparatus operated by a mobile network provider, the content selection apparatus in communication with the mobile communications device, a broadcaster database associated with the broadcaster, and a content provider database, wherein the content selection apparatus is configured to receive the message from the mobile communications device, obtain the time, source, and perceiver identification information included in each message, use the time and source information to obtain identification of the audio content from the broadcaster database, and instruct a content provider maintaining the content provider database to transmit a copy of the audio content to a location specified by pre-determined settings of a user, wherein the pre-determined settings of the user are stored in memory; and wherein at least one broadcaster database includes multiple broadcaster databases, and said content selection apparatus is configured to use the source information to identify an associated broadcaster database from the multiple broadcaster databases that is associated with the audio content and to use at least one of the time or source information to obtain identification of the audio content from the associated broadcaster database.

22. A system according to claim 21, wherein the content selection apparatus operated by the mobile network provider is communicatively disposed between the mobile communications device and the content provider database.

23. A system according to claim 21, wherein said content selection apparatus is further configured to automatically obtain, from the content provider database, a copy of the audio content disseminated by the broadcaster, and store the obtained copy of the audio content in a memory of the content selection apparatus.

* * * * *